United States Patent [19]

Hamsher, Jr.

[11] Patent Number: 4,556,275

[45] Date of Patent: Dec. 3, 1985

[54] ELECTRICAL PANELBOARD CONNECTOR

[75] Inventor: Wilbur A. Hamsher, Jr., New Cumberland, Pa.

[73] Assignee: AMP Incorporated, Harrisburg, Pa.

[21] Appl. No.: 523,202

[22] Filed: Aug. 15, 1983

Related U.S. Application Data

[63] Continuation-in-part of Ser. No. 506,964, Jun. 23, 1983, Pat. No. 4,491,381.

[51] Int. Cl.[4] ..... H01R 13/58

[52] U.S. Cl. ..... 339/218 M; 29/858; 339/14 R; 339/74 R

[58] Field of Search ..... 339/14 R, 74 R, 75 R, 339/99 R, 103 M, 107, 218 N, 218 R, 275 R, 276 R; 29/858

[56] References Cited

U.S. PATENT DOCUMENTS

| | | | |
|---|---|---|---|
| 3,141,054 | 7/1964 | Francis | 339/218 R X |
| 3,533,044 | 10/1970 | Bauman et al. | 339/14 |
| 3,673,542 | 6/1972 | Di Stefano et al. | 339/14 R |
| 3,705,376 | 12/1972 | Kinkaid et al. | 339/75 R X |
| 3,796,987 | 3/1974 | Kinkaid et al. | 339/74 R X |
| 3,864,010 | 2/1975 | Wasserlein, Jr. | 339/97 R |
| 3,874,764 | 4/1975 | Volinskie | 339/97 R |
| 4,040,703 | 8/1977 | Shaffer et al. | 339/99 R |
| 4,277,124 | 7/1981 | Loose et al. | 339/99 R |

FOREIGN PATENT DOCUMENTS

| | | | |
|---|---|---|---|
| 669608 | 9/1963 | Canada | 339/218 M |

*Primary Examiner*—Eugene F. Desmond

*Attorney, Agent, or Firm*—Adrian J. LaRue; Anton P. Ness

[57] ABSTRACT

An electrical connector comprises a dielectric housing member in which signal and ground terminal members are secured with contact sections of the terminal members in alignment with respective openings at a front end of the housing member into which a pin terminal and a ground rail of a panelboard extend for electrical connection with the contact sections of the signal and ground terminal members. Termination sections of the signal and ground terminal members are terminated to the signal and ground conductors of a cable. A securing section is part of the signal terminal member or ground terminal member in which a section of the cable is secured as a cable strain relief. A profiled dielectric cover member encapsulates the termination sections terminated to the signal and ground conductors and the securing section secured to the cable section and a section of the cable as an added cable strain relief thereby forming an electrical terminal assembly that is latchably secured in the housing member.

10 Claims, 6 Drawing Figures

ELECTRICAL PANELBOARD CONNECTOR

CROSS-REFERENCE TO RELATED APPLICATION

This is a continuation-in-part of U.S. patent application Ser. No. 506,964 filed June 23, 1983, now U.S. Pat. No. 4,491,381.

FIELD OF THE INVENTION

The present invention relates to electrical connectors and more particularly to electrical connectors for connecting electrical cables to electrical terminals of a panelboard, circuit board or the like.

BACKGROUND OF THE INVENTION

Several types of electrical cables are used in electrical connectors for connecting the cables to electrical terminals of a panelboard, circuit board or the like. One type is a trilead cable of generally rectangular configuration in cross-section and having a signal conductor with ground conductors along opposite sides encased in an insulating jacket. Another type is a circular shielded trilead cable which includes an outer conductor electrically encircling the ground conductors between the insulated signal conductor and the insulating jacket. A further type is a shielded trilead triaxial cable which has a ground wire and braided conductor extending along the insulating jacket and surrounded by an outer insulating jacket.

An electrical connector disclosed in U.S. patent application Ser. No. 506,964 filed June 23, 1983 terminates each of these cables, but the housing member has cover members latchably secured together and movably mounted thereto to cover the terminations of the cable conductors to the electrical terminals latchably mounted in the housing member; the cover members also enhance the strain relief to the terminations and the cable. The housing member and cover members result in a more complex and expensive structure because three molds are required to make them, the latching arrangement between the cover members can be damaged which will not provide an effective cover over the electrical terminations, and the terminations are not sealed.

SUMMARY OF THE INVENTION

According to the present invention, an electrical connector comprises signal and ground terminal members having termination sections for terminating signal and ground conductors of a cable thereto. A securing section is part of the signal terminal member or ground terminal member for securing a section of the cable therein as a cable strain relief. The termination sections to which the signal and ground conductors are terminated and the securing section are encapsulated in a profiled cover of dielectric material to protect the terminations, maintain the terminal members in spaced and isolated relationship as an electrical terminal assembly, and provide additional cable strain relief, the electrical terminal assembly being positioned in a passageway of a dielectric housing member with contact sections of the terminal members in alignment with respective openings at a front end of the housing member into which a pin terminal and a ground rail of a panelboard extend for electrical connection with the contact sections of the signal and ground terminal members. Securing members on the terminal members in association with securing sections of the housing member secure the electrical terminal assembly in the housing member with the profiled dielectric material being disposed within the passageway.

According to another feature of the present invention, the housing member passageway includes a section enabling electrical contacts of a probe to extend along the profiled dielectric cover material and electrically engage the signal and ground terminal members to determine the integrity of the electrical terminations and the electrical connections.

According to a further feature of the present invention, the contact section of the signal terminal member is latchably connected onto the pin terminal and can be disconnected therefrom by movement of the housing member away from the pin terminal which releases the signal terminal member therefrom.

DETAILED DESCRIPTION OF THE INVENTION

Figure 1:
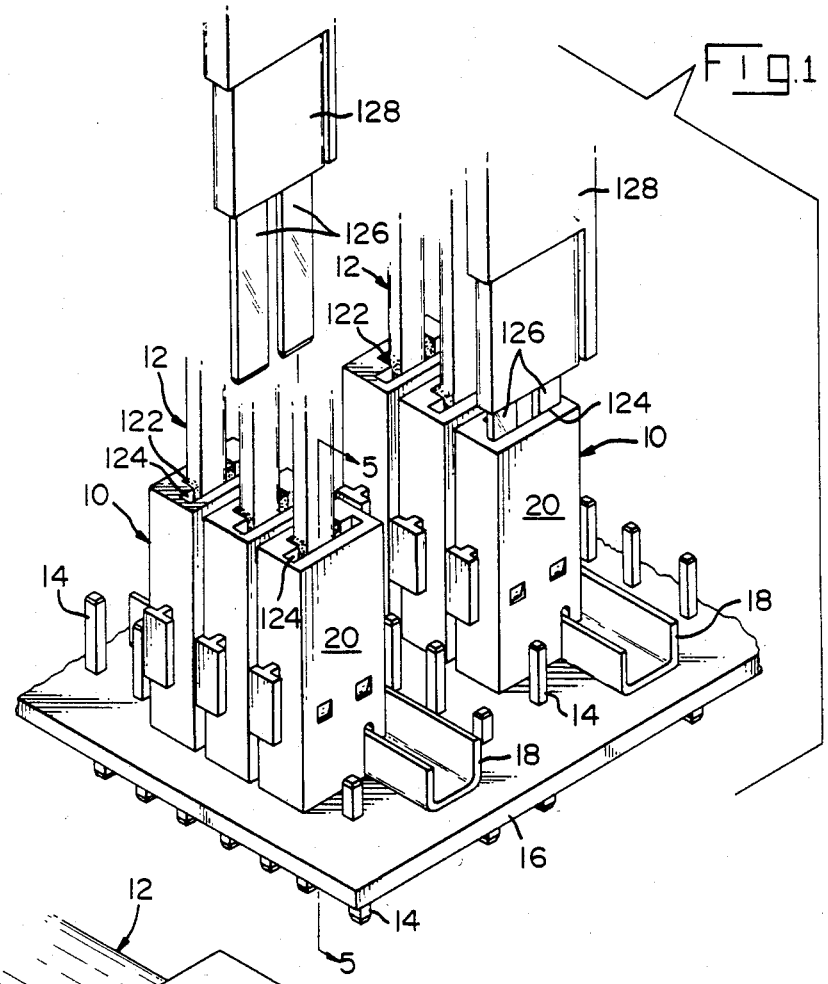
FIG. 1 is a fragmentary perspective view showing a portion of a panelboard having terminal pins and ground rails mounted thereon and with electrical connectors making electrical interconnection therewith, and an electrical probe exploded therefrom.

Electrical panelboard connectors 10 are shown in use in FIG. 1 whereby they terminate the signal and ground conductors of electrical cables 12 and electrically connect them to respective pin terminals 14 arranged in rows in panelboard 16 on opposite sides of elongated channel-shaped ground rails 18.

Each of electrical panelboard connectors 10 includes a dielectric housing member 20, a signal terminal member 22 and a ground terminal member 24. Dielectric housing member 20 is molded from a suitable plastic material and signal terminal and ground terminal members 22 and 24 are stamped and formed from a suitable metal having the desired spring characteristics.

Figure 2:
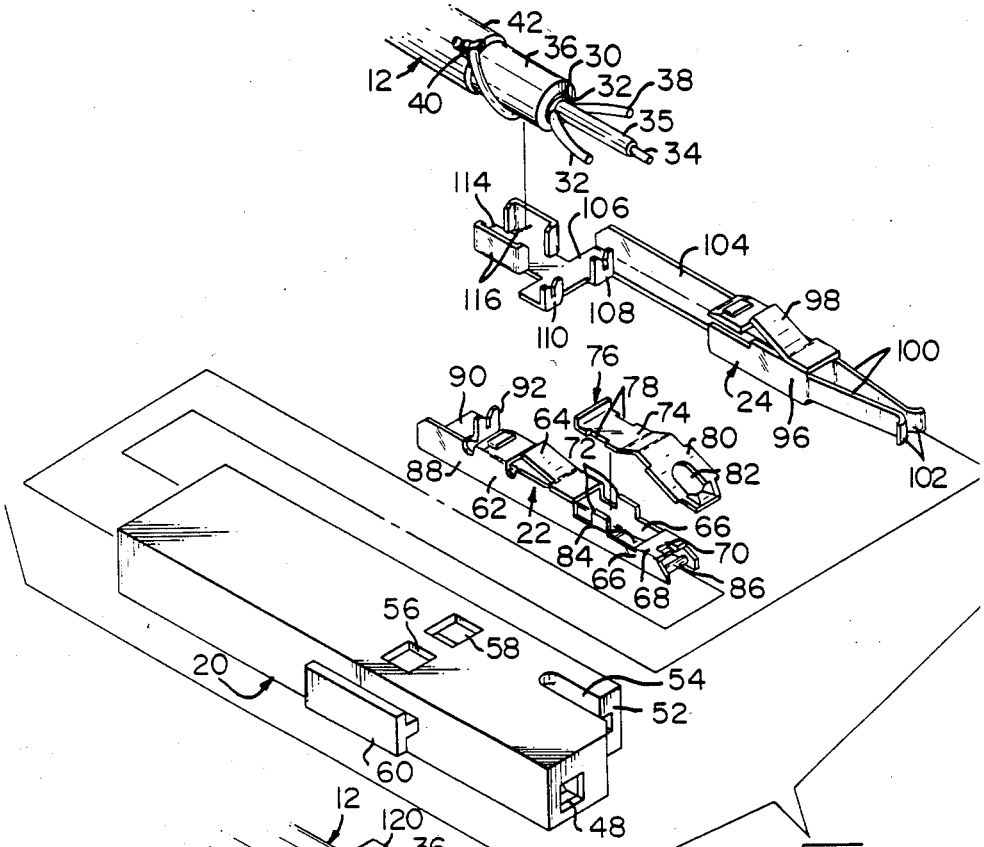
FIG. 2 is a perspective exploded view of the parts of the electrical connector and a stripped end of a cable.

Cable 12 is a circular shielded trilead triaxial cable which includes an outer conductor 30 electrically encircling the ground conductors 32 between signal conductor 34 and insulating jacket 36, an insulation sheath 35 covers signal conductor 34. A ground conductor 38 and braid 40 extend along insulating jacket 36 and are covered by outer insulating jacket 42. Cable 12 is stripped as shown in FIG. 2 with one of ground conductors 32 being cut off at the end of outer conductor 30 and insulating jacket 36 prior to the stripped end of cable 12 being terminated in signal and ground terminal members 22 and 24.

Housing member 20 includes parallel passageways 44 and 46 in which signal terminal member 22 and ground terminal member 24 are respectively disposed. Passageway 44 is in communication with an opening 48 at the front end of housing member 20. A camming surface 50 is located at the front end of passageway 44. Housing member 20 includes a stepped section 52 spaced from the front surface which has a slot 54 therein that is in communication with passageway 46. Latching apertures 56 and 58 are located in housing member 20 in communication with passageways 44 and 46. A T-shaped member 60 is located on housing member 20 which is to be engaged by a tool (not shown) to facilitate the mounting on and removal from the pin terminals and ground rails of panelboard 16.

Figure 4:
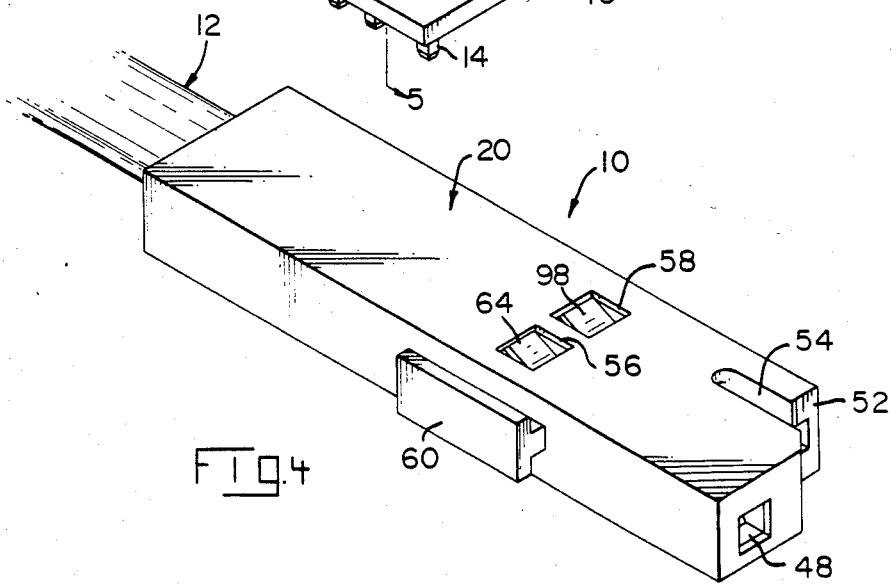
FIG. 4 is a perspective view showing the connecter in an assembled condition.
Figure 5:
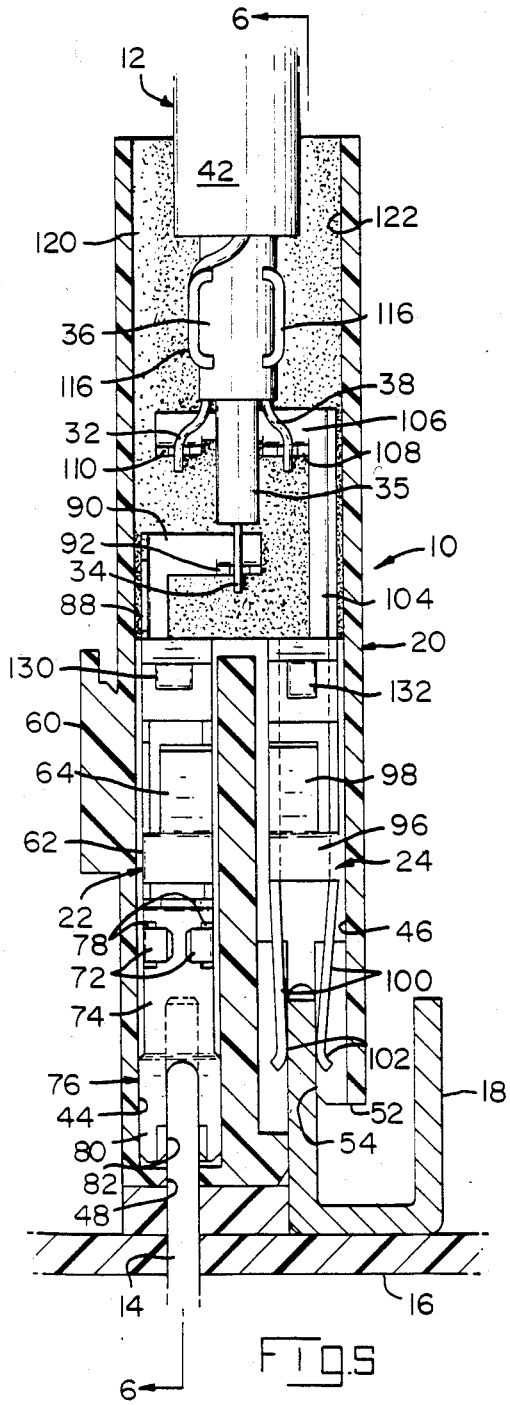
FIG. 5 is a longitudinal section view taken along line 5—5 of FIG. 1.
Figure 6:
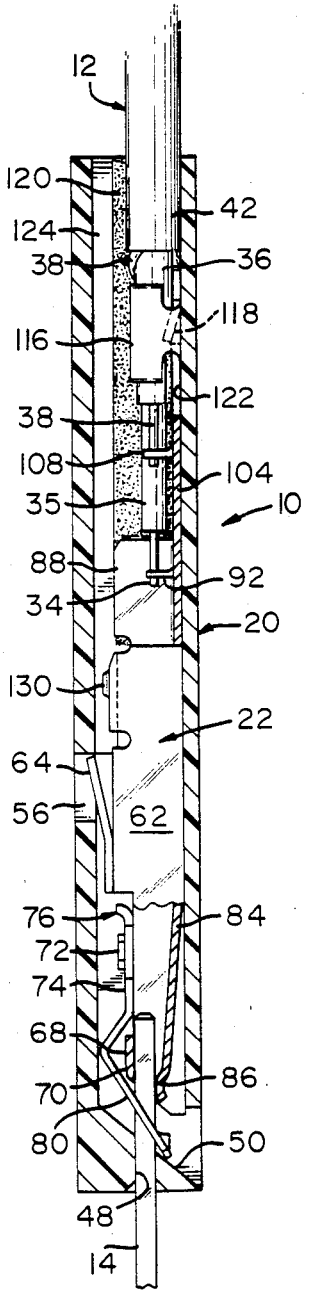
FIG. 6 is a longitudinal section view taken along line 6—6 of FIG. 5.

Signal terminal member 22 is of the type disclosed in U.S. Pat. Nos. 3,705,376 and 3,796,987 and has a box-shaped section 62 from which extends a lance 64 that is disposed within latching aperture 56 when terminal member 22 is disposed in passageway 44 of housing member 20 latching terminal member 22 in position therein as shown in FIGS. 4 and 6. Side members 66 extend outwardly from the sides of section 62 in a forward direction therefrom in parallel relationship to one another and they are connected at their front ends by a bridging member 68 which has a radiused section 70 struck inwardly therefrom. Lugs 72 extend outwardly from the top surfaces of side members 66 opposite one another and they are bent into engagement with a flat section 74 of spring member 76 which engages the top surfaces of side members 66 and is maintained in engagement therewith. Recesses 78 are located in flat section 74 in which lugs 72 are disposed to prevent spring member 76 from moving back and forth along side members 66. A profiled spring section 80 is located at the front end of spring member 76 and extends across the front end of terminal member 22. An elongated aperture 82 is located in spring section 80 in alignment with opening 48 to permit pin terminal 14 to have access to the receptacle section of terminal member 22 through aperture 82 as shown in FIGS. 5 and 6. Leaf spring contact member 84 is cantilevered outwardly from the bottom of box-shaped section 62 in a direction toward bridging member 68 and terminates with a radiused front end 86 spaced forwardly from radiused section 70. Thus, when pin terminal 14 is inserted into the receptacle section of terminal member 22 through elongated aperture 82 of spring section 80, radiused section 70 and radiused front end 86 electrically and wipingly engage pin terminal 14 at axiallly-spaced locations and spring section 80 engages pin terminal 14 thereby locking it in position therein. Movement of housing member 20 away from panelboard 16 causes spring section 80 to engage camming surface 50 which moves spring section 80 free of pin terminal 14 enabling connector 10 to be removed from panelboard 16. An L-shaped terminating section 88 extends rearwardly from box-shaped section 62 and it has a projection 90 which includes a slotted terminating member 92.

Ground terminal member 24 has a box-shaped section 96 from which is struck a lance 98 for disposition in latching aperture 58 to latchably secure terminal member 24 in passageway 46 of housing member 20 as shown in FIG. 4. Leaf spring contact members 100 are cantilevered respectively from the sides of section 96 in a direction toward each other and they have radiused front ends 102 disposed within slot 54 as shown in FIG. 5, with radiused front ends 102 electrically engaging a leg of ground rail 18 through slot 54. L-shaped terminating section 104 extends rearwardly from box-shaped section 96 and has a projection 106 which includes slotted terminating members 108 and 110. A strain relief section 114 extends outwardly from projection 106 and it includes C-shaped sidewalls 116 and a forwardly-directed projection 118 struck from the web connecting sidewalls 116 of strain relief section 114 as shown in FIG. 6.

With terminals 22 and 24 held in a spaced relationship as they will be when they are latchably mounted in housing member 20 within a holding member (not shown), a stripped end of cable 12 is terminated to terminal members 22 and 24. With ground conductor 38 disposed under insulating jacket 36, insulating jacket 36 is forced between C-shaped sidewalls 116 and into engagement with forwardly-directed projection 118 thereby providing a strain relief for cable 12 in strain relief section 114. Ground conductors 32 and 38 are positioned in terminating members 110 and 108 while signal conductor 34 is positioned in terminating member 92 and these conductors are preferably welded or soldered in position therein though the terminating members will effectively terminate the conductors. Terminating members 92, 108 and 110 can be in the form of crimping ferrules crimped onto conductors 32, 34 and 38. As can be discerned from FIGS. 5 and 6, C-shaped sidewalls 116 and forwardly-directed projection 118 bite into insulating jacket 36 thereby forming a strain relief for cable 12.

Figure 3:
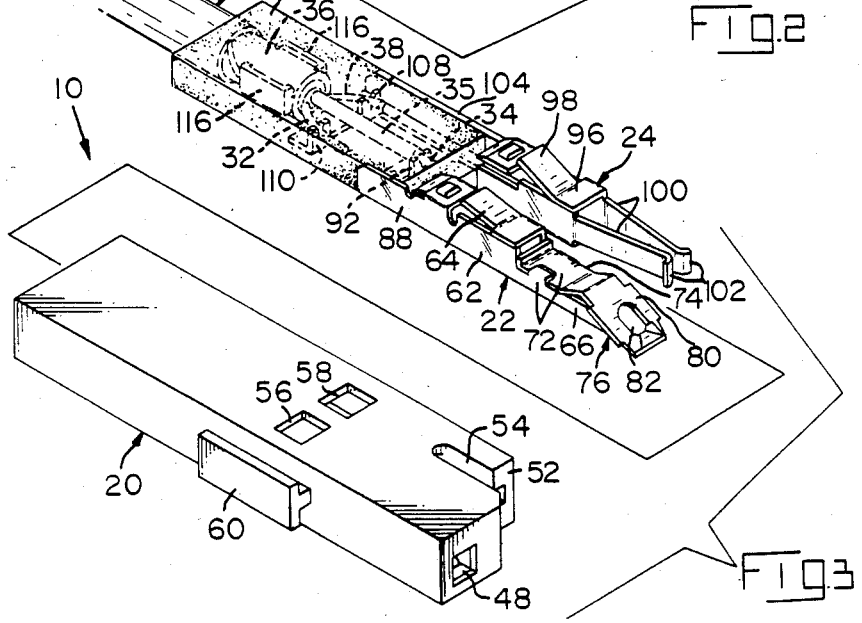
FIG. 3 is a perspective view showing the signal and ground conductors of the cable terminated to the signal and ground terminal members and the terminal members encapsulated in a profiled cover of dielectric material as an electrical terminal assembly ready for insertion in a dielectric housing member.

The terminated terminals 22 and 24 are now positioned in a mold (not shown) and injectable insulating material in a hot flowable condition is injected into the mold forming a profiled dielectric cover 120, as shown in FIGS. 3, 5 and 6, which entirely encapsulates the terminations of conductors 34, 32 and 38 in terminating members 92, 110 and 108 and the section of cable 12 in strain relief section 116 including a section of cable 12 as shown in FIGS. 3, 5 and 6. The cover 120 is formed into a substantially rigid condition after cooling thereby forming an electrical terminal assembly that is insertable along and disposed in passageway 122 of housing member 20 with the uncovered sections of terminals 22 and 24 being disposed in passageways 44 and 46 and latched therein via lances 64 and 98 disposed in latching apertures 56 and 58. The electrical terminal assembly is entirely disposed within the passageways 44, 46 and 122 which are in communication.

The profiled dielectric cover 120 maintains the terminals 22 and 24 in proper spaced relationship, seals the terminations and adds additional strain relief to strain relief section 116. A one-piece housing member 20 is used to completely cover the electrical terminal assembly when latchably secured therein. Housing member 20 is movable relative to the electrical terminal assembly to move camming surface 50 in engagement with spring section 80 to remove connector 10 from pin terminal 14 and ground rail 18.

Passageway 122 of housing member 20 includes a section 124 as shown in FIGS. 1 and 6 which forms passageway 122 into a T-shape configuration. Contact members 126 of electrical probe 128 extend along section 124 and cover 120 and make electrical contact with terminals 22 and 24 between cover member 20 and projections 130 and 132 on sections 62 and 96 of terminals 22 and 24. Probe 128 checks the terminations and connections of terminals 22 and 24 while connectors 10 are in position on panelboard 16 as shown in FIG. 1.

From the foregoing, an electrical panelboard connector of simplified construction has been disclosed for terminating electrical conductors of a multiconductor cable to terminating sections of signal and ground electrical terminals which are formed into an electrical terminal assembly by a molded dielectric cover that covers and seals the terminating sections and strain relief section of the terminals, provides additional strain relief, and maintains the terminals in spaced and isolated relationship so that the electrical terminal assembly is secured in a passageway of a dielectric housing member with contact sections of the terminals being electrically connectable to a pin terminal and ground rail of a panelboard through openings in the front end of the housing member in alignment with the contact sections of the terminals.

I claim:

1. An electrical connector for terminating signal and ground conductor means of a trilead cable means and electrically connecting the signal and ground conductor means respectively to a pin terminal and a ground rail of a panelboard, comprising:

dielectric housing means having parallel passageway means and another passageway means extending therethrough, said parallel passageway means communicating with said other passageway means and respective opening means at a front end of said housing means into which the pin terminal and ground rail extend;

signal terminal means disposed in one of said parallel passageway means and including contact means and termination means, said contact means being in alignment with one of said opening means for electrical connection with the pin terminal, said termination means extending along said other passageway means of said housing means and being terminated to the signal conductor means;

ground terminal means disposed in the other of said parallel passageway means and including contact member means and termination member means, said contact member means being in alignment with the other of said opening means for electrical connection with the ground rail, said termination member means extending along said other passageway means of said housing means insulated from said signal terminal means and being terminated to the ground conductor means;

one of said signal terminal means and said ground terminal means having cable securing means engaging the cable means thereby securing the cable means thereto and providing a cable strain relief;

terminal securing means on said signal terminal means and said ground terminal means and said housing means securing said terminal means in said housing means;

latching means on said signal terminal means which latchably engages the pin terminal when electrically connected therewith;

means in said passageway means containing said signal terminal means engageable with said latching means when said housing means is moved axially relative to said signal terminal means thereby causing said latching means to be unlatched from the pin terminal enabling the connector to be disconnected from the pin terminal and the ground rail; and profiled dielectric cover means extending along said other passageway means of said housing means and encapsulating said termination means and said termination member means and engaging a section of the cable means secured in said cable securing means thereby sealing said terminating means and said termination member means and providing additional cable strain relief.

2. An electrical connector as set forth in claim 1, wherein said other passageway means has section means in alignment with intermediate sections of said signal and ground terminal means so that electrical contact members of an electrical probe means can pass along the section means and make electrical connection with the intermediate section.

3. An electrical connector as set forth in claim 1, wherein said cable securing means is part of said signal terminal means.

4. An electrical connector as set forth in claim 1, wherein said cable securing means is part of said ground terminal means.

5. An electrical connector as set forth in claim 1, wherein said cover means includes an insulating material molded onto the termination means, the termination member means, the cable securing means and a section of the cable means as a substantially rigid member.

6. An electrical connector as set forth in claim 1, wherein said termination member means is located rearwardly from said termination means of said signal terminal means.

7. An electrical connector as set forth in claim 1, wherein said connector has a low profile and is relatively planar with both signal and ground terminal means located in said plane, whereby a plurality of said connectors may be closely spaced.

8. An electrical connector as set forth in claim 1, wherein said termination means of said signal and ground terminal means comprise slotted terminating members axially normal to said signal and ground conductors whereby said conductors are disposed in said slotted terminating members.

9. An electrical connector as set forth in claim 1, wherein said termination means of said signal and ground terminal means comprise crimping ferrules crimpable around said signal and ground conductors respectively.

10. A method of assembling an electrical connector for terminating signal and ground conductor means of a trilead cable means and electrically connecting same to a pin terminal and a ground rail of a panelboard comprising the steps of:

terminating a termination means of a signal terminal means to said signal conductor means of said cable means and terminating a termination member means of a ground terminal means to said ground conductor means;

securing a section of said cable means with a cable securing means on one of said signal terminal means or said ground terminal means;

inserting said signal terminal means and said ground terminal means inside a mold means;

molding dielectric cover material around said signal and ground terminal means rearward of intermediate sections thereof and around said secured section of said cable means and said termination means and said termination member means forming a sealed terminal assembly;

inserting said sealed terminal assembly into a rearward passageway of a dielectric housing member; and securing said assembly in said housing member such that intermediate and contact sections of said terminal means extend along parallel passageways of said housing member, said parallel passageways having openings such that said signal terminal means is electrically engageable with a said pin terminal of said panelboard, said ground terminal means is electrically engageable with a said ground rail of said panelboard, and said dielectric housing member is axially movable relative to said sealed terminal assembly to unlatch said signal terminal means from electrical engagement with a said pin terminal.

* * * * *